US005828283A

United States Patent [19]

Choi et al.

[11] Patent Number: 5,828,283

[45] Date of Patent: Oct. 27, 1998

[54] APPARATUS FOR CONNECTING PRIMARY CONDUCTIVE LINES OF FLEXIBLE TRANSFORMER

[75] Inventors: Chang-Gu Choi, Taejon; Ha-Eun Nam, Seoul, both of Rep. of Korea

[73] Assignee: Daewoo Electronics Co., Ltd., Seoul, Rep. of Korea

[21] Appl. No.: 772,753

[22] Filed: Dec. 23, 1996

[30] Foreign Application Priority Data

Dec. 31, 1995 [KR] Rep. of Korea ..... 95-72216

[51] Int. Cl.[6] ..... H01F 27/28

[52] U.S. Cl. ..... 336/200; 336/206; 336/223; 336/229

[58] Field of Search ..... 336/200, 223, 336/229, 206, 225

[56] References Cited

U.S. PATENT DOCUMENTS

| | | | |
|---|---|---|---|
| 4,536,733 | 8/1985 | Shelly | 336/229 |
| 4,975,671 | 12/1990 | Dinks | 336/200 |
| 5,191,699 | 3/1993 | Ganslmeier et al. . | |

FOREIGN PATENT DOCUMENTS

| | | | |
|---|---|---|---|
| 44-29688 | 12/1966 | Japan | 336/200 |
| 55-128805 | 6/1980 | Japan | 336/229 |
| 61-237407 | 10/1986 | Japan | 336/229 |
| 2-10705 | 1/1990 | Japan | 336/200 |
| 5-29149 | 2/1993 | Japan | 336/200 |
| 771701 | 4/1957 | United Kingdom | 336/200 |
| 2260222 | 4/1993 | United Kingdom . | |
| WO94/14174 | 6/1994 | WIPO . | |

OTHER PUBLICATIONS

IBM Technical Disclosure Bulletin, vol. 17, No. 7, Dec. 1974, "Hybrid Toroidal TransFormer Winding", A Werner p. 1993.

*Primary Examiner*—Thomas J. Kozma
*Attorney, Agent, or Firm*—Beveridge, DeGrandi, Weilacher & Young, LLP

[57] ABSTRACT

An apparatus for connecting primary conductive lines of a flexible transformer which assures the simple and reliable connection between the primary conductive lines. The apparatus includes a circular rigid supporting plate having an opening at the center thereof, a connecting member having an opening at the center thereof fabricated of a flexible insulator sheet having one surface where the supporting plate is adhered and the other surface where a plurality of radial conductive lines are deposited. The connecting member has a plurality of projecting portions at inner and outer peripheral edge portions thereof by cutting out the inner and outer peripheral edge portions where the radial conductive lines are not deposited. The projecting portions are folded to connect inner and outer parallel primary conductive lines.

10 Claims, 4 Drawing Sheets

APPARATUS FOR CONNECTING PRIMARY CONDUCTIVE LINES OF FLEXIBLE TRANSFORMER

BACKGROUND OF THE INVENTION

1. Field of the Invention

The present invention relates to the connection of primary conductive lines of a flexible transformer and more particularly to an apparatus for connecting primary conductive lines of a flexible transformer in use of electrically connecting inner and outer cylindrical primary structures.

2. Description of the Prior Art

Transformers are utilized in various fields. Transformers are devices that increase or decrease the voltage of alternating current. They are usually fabricated by winding several coils of wire around a large magnetic core. Cores may be cylindrical, but typically toroidal cores are used. One coil, called the primary coil, is connected to the input circuit, in which the voltage is to be changed. The other coil, called the secondary coil, is connected to the output circuit, where the electricity with the changed (increased or decreased) voltage is used.

Since coil winding is a long and tedious process, the designe of a commercial transformer is primarily driven by cost. In other words, manufacturers try to minimize core size and coil length. However, there is a practical limit to decreasing the size of transformers, and the smallest transformers, which would be desirable for high frequency applications, are very expensive to produce. A reduction in size usually reduces cost as a result of less material needed to build them, but a continued reduction in size increases the cost of assembly exponentially.

U.S. Pat. No. 5,392,020, entitled "FLEXIBLE TRANSFORMER APPARATUS PARTICULARLY ADAPTED FOR HIGH VOLTAGE OPERATION" issued on Feb. 21, 1995 to Chang, discloses a transformer apparatus which utilizes flexible laminated transformer elements.

FIG. 1 is a top view of Chang's transformer showing the connection between inner and outer primary structures. An inner primary cylinder 10 and an outer primary cylinder 12 are shown with a secondary configuration shown in dashed lines positioned concentrically between the primary cylinders. A plurality of parallel conductive lines 14 are formed on an inner wall of inner primary cylinder 10. A plurality of parallel conductive lines 16 which are wider in width than conductive lines 14 are formed on an outer wall of outer primary cylinder 12. The number of conductive lines 16 on the outer wall of outer primary cylinder 12 is the same as the number of conductive lines 14 on the inner wall of inner primary cylinder 10. Inner and outer primary cylinders 10 and 12 are electrically connected with each other by means of suitable devices. As shown, inner primary cylinder 10 is connected to outer primary cylinder 12 by means of conductive wires 18.

However, the wire connection between spaced conductive lines is a long and tedious process which causes an increases in the manufacturing cost.

Furthermore, Chang discloses a cap structure for connecting the primary cylinders. However, the cap structure still utilizes wires for the connection of the primary cylinders, and a method for connecting the cap structure and the conductive lines is not described concretely. As a result, there is a problem that a reliable connection between the cap structure and conductive lines 14 and 16 deposited on inner and outer primary cylinders 10 and 12 can not be assured.

SUMMARY OF THE INVENTION

The present invention is devised to solve the foregoing problem. It is a first object of the present invention to provide an apparatus for connecting primary conductive lines capable of connecting the primary conductive lines simply and reliably.

It is a second object of the present invention to provide a method for connecting primary conductive lines capable of connecting the primary conductive lines simply and reliably.

To achieve the first object of the present invention, there is provided an apparatus for connecting primary conductive lines of a transformer comprising:

- a rigid supporting plate of a circular disc shape with an opening at the center thereof; and
- a connecting member of a flexible insulator sheet having one surface on which the supporting plate is adhered, the other surface on which a plurality of radial conductive lines are deposited, an opening at the center thereof and a plurality of projecting portions at inner and outer peripheral edge portions thereof by cutting out the inner and outer peripheral edge portions where the radial conductive lines are not deposited, whereby the projecting portions positioned at the inner peripheral edge portion of the connecting member are folded to connect inner terminal edges of the radial conductive lines with terminal ends of the first parallel primary conductive lines, respectively and the projecting portions positioned at the outer peripheral edge portion of the connecting member are folded to connect outer terminal edges of the radial conductive lines with terminal ends of the second parallel primary conductive lines so that a primary winding is fabricated which surrounds the secondary winding.

To achieve the second object of the present invention, there is provided a method for connecting primary conductive lines of a transformer comprising the steps of:

- depositing a copper layer on a surface of a connecting member fabricated of a circular flexible insulator sheet having an opening at the center thereof;
- removing portions of the copper layer to form a plurality of radial conductive lines;
- cutting out inner and outer peripheral edge portions of the connecting member where the copper layer is removed to form a plurality of projecting portions at the inner and outer peripheral edge portions of the connecting member;
- forming a solder layer on each of terminal ends of the first and second parallel primary conductive lines;
- laying the connecting member on a side of the transformer to expose a surface of the connecting member on which the copper layer is not deposited; and
- soldering the solder layer with inner and outer terminal edges of the radial conductive lines whereby the terminal ends of the first parallel primary conductive lines are connected with those of the second parallel primary conductive lines, respectively so that a primary winding is fabricated which surrounds the secondary winding.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

Hereinafter, the preferred embodiment of the present invention will be described in detail with reference to FIGS. 2 to 5.

Figure 1:
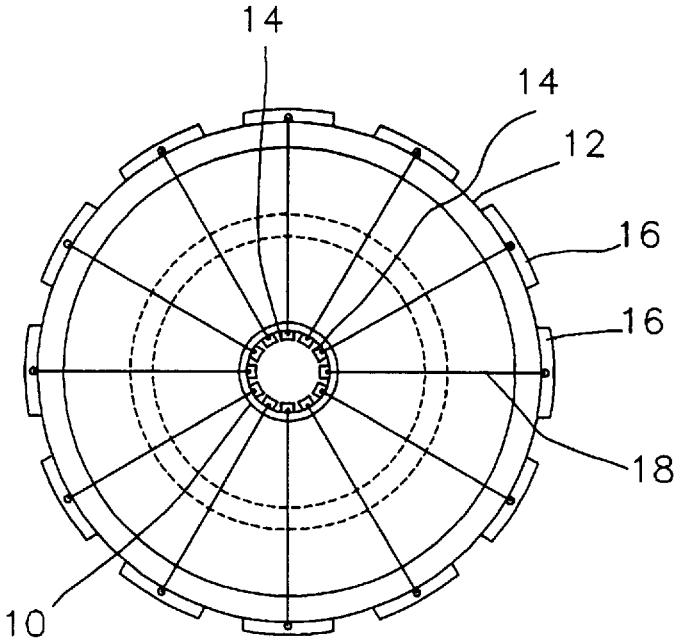
FIG. 1 PRIOR ART
FIG. 1 is a top view of a conventional transformer apparatus showing the connection between inner and outer cylindrical primary structures.
Figure 2:
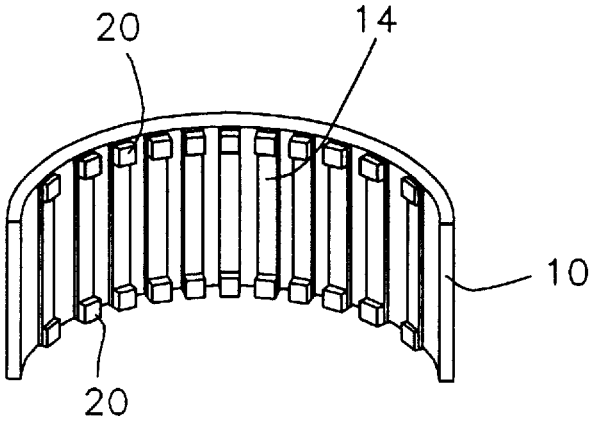
FIG. 2 is a perspective view of a flexible primary sheet utilized as the inner cylindrical primary structure according to the present invention.

FIG. 2 shows a flexible primary sheet 10 utilized as an inner cylindrical primary structure which is shown as inner primary cylinder 10 in FIG. 1. Primary sheet 10 is made of a flexible insulator film such as polyimide or polyester. A plurality of parallel conductive lines 14 are deposited on a surface of primary sheet 10.

A plurality of parallel conductive lines 14 are formed by conventional evaporation techniques. A copper layer is deposited on a flexible insulator film of polyimide or the like. Preferably, the copper layer is deposited by sputtering procedures but may be formed by other conventional techniques. The deposited copper layer is patterned and then etched to form a plurality of parallel conductive lines 14.

Each conductive line 14 of the plurality has land areas 20 at terminal ends thereof, the land areas being formed of a solder. The solder may be a cream type solder but is not especially limited to the cream type solder. When the cream type solder is used, land areas 20 are formed by, for example, screen printing. When an ordinary solder is used, land areas 20 are formed by, for example, dipping. Besides, land areas 20 may be formed by solder plating.

Figure 3:
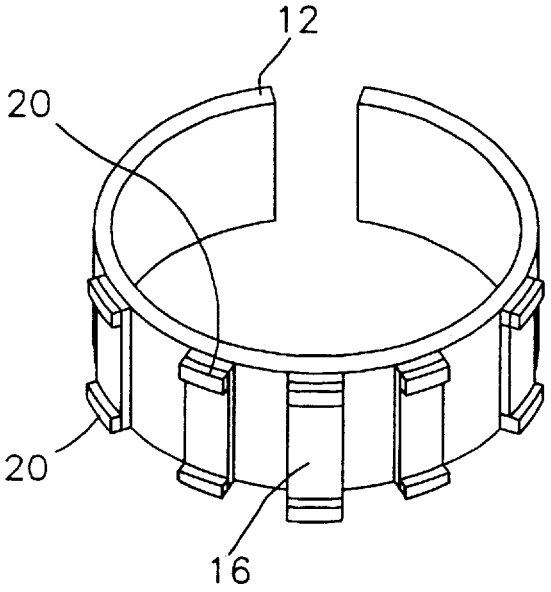
FIG. 3 is a perspective view of a flexible primary sheet utilized as the outer cylindrical primary structure according to the present invention.

FIG. 3 shows a flexible primary sheet 12 utilized as an outer cylindrical primary structure which is shown as outer primary cylinder 12 in FIG. 1. Primary sheet 12 is made of a flexible insulator film such as polyimide or polyester. A plurality of parallel conductive lines 16 are deposited on a surface of primary sheet 12. Conductive lines 16 are wider in width than conductive lines 14 deposited on primary sheet 10 and are formed by the same methods as conductive lines 14.

Each conductive line 16 of the plurality has land areas 20 at terminal ends thereof, the land areas being formed of a solder. The kind of solder used and the formation method thereof are as previously described.

Figure 4A:
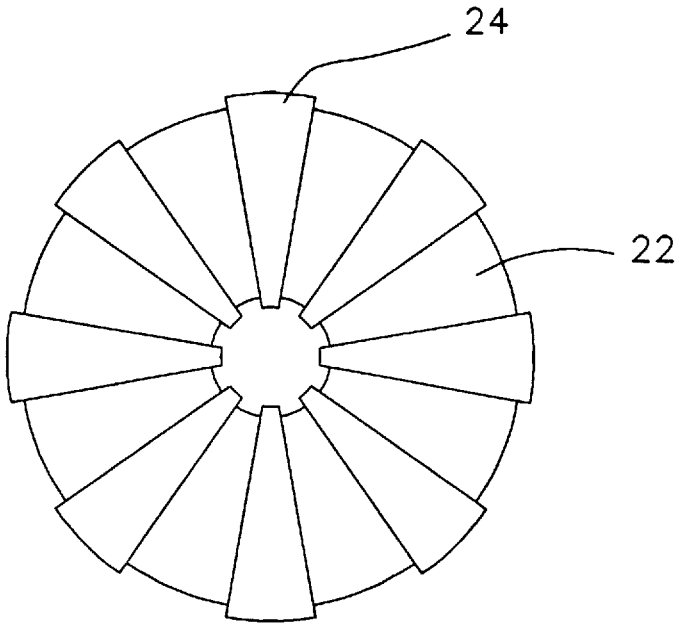
FIG. 4A is a top view of a connecting member for electrically connecting primary conductive lines according to the present invention.
Figure 4B:
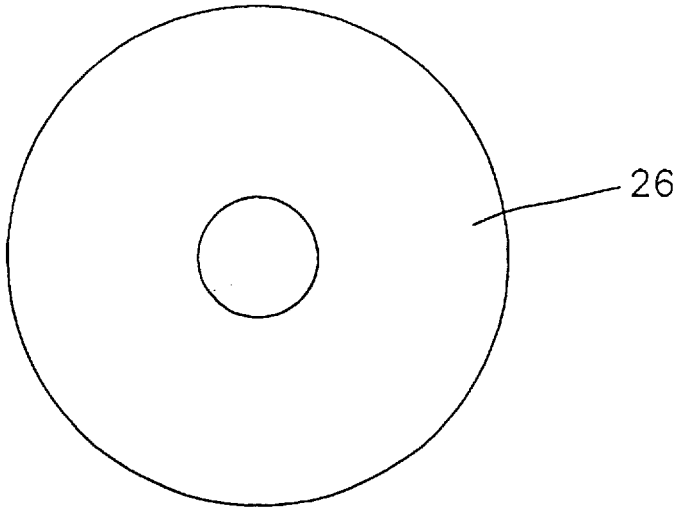
FIG. 4 B is a top view of a supporting plate according to the present invention.

FIG. 4A shows a connecting member 22. Connecting member 22 is made of a flexible insulator sheet such as polyimide or polyester and has a plurality of radial conductive lines 24. Connecting member 22 is shaped to a circular disc with an opening at the center thereof. Each conductive line 24 of the plurality has a radially wider shape in width. Conductive lines 24 are formed by depositing a copper layer on the flexible insulator sheet of polyimide, polyester or the like with sputtering technique or laminating a copper film thereon, and then patterning and etching the copper layer or the copper film. After etching, inner and outer peripheral edges of portions of the insulator sheet on which the copper layer or the copper film is removed are cut out to radially project terminal end portions of each conductive lines 24. FIG. 4B shows a supporting plate 26 for supporting connecting member 22 shown in FIG. 4A. Supporting plate 26 is shaped to a circular disc shape with an opening at the center thereof and made of a rigid material such as fiberglass reinforced plastic(hereinafter, referred to as FRP). FRP is finespun filaments of glass made into yarn woven into textiles. FRP is used in wooly masses as insulation, and is pressed and molded as plastic material. Properties of the FRP are that it is light weight and plastic. The apparatus for electrically connecting primary conductive lines of flexible transformer uses FRP for an insulator. Supporting plate 26 is adhered to a surface of connecting member 22 where the copper layer has not been deposited, so that the terminal end portions of each of conductive lines 24 are projected from inner and outer peripheral edges of supporting plate 26.

Figure 5:
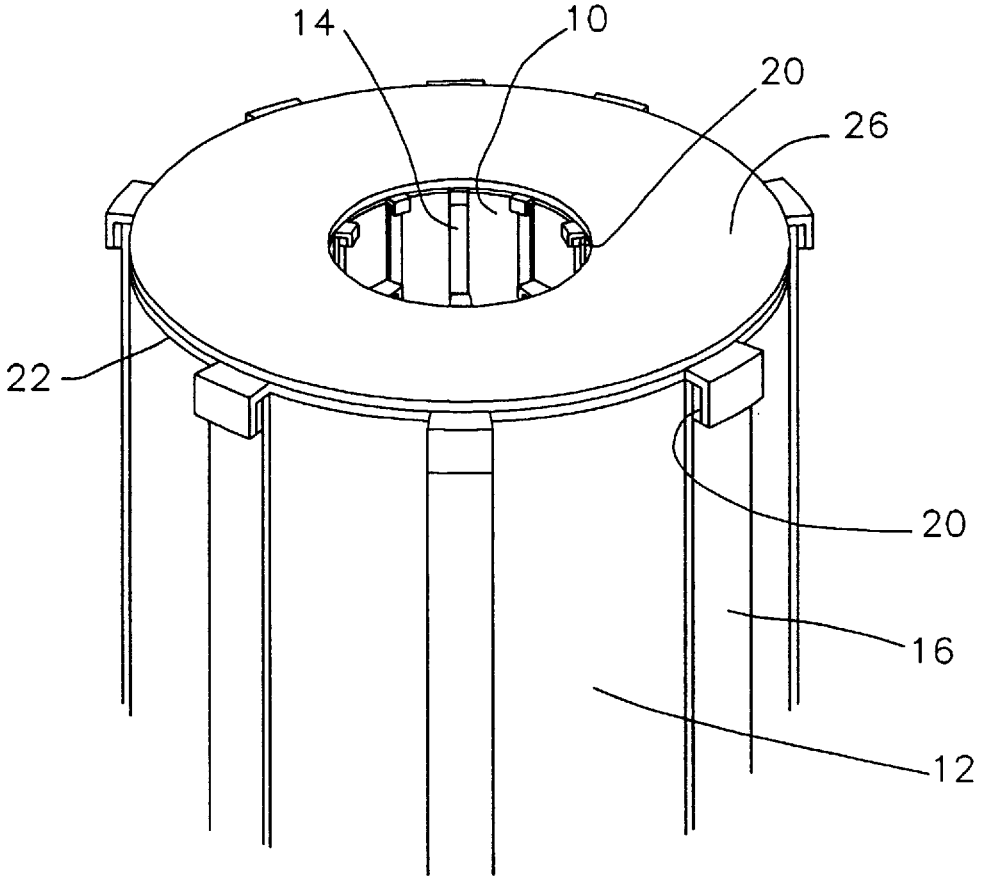
FIG. 5 is a perspective view showing a transformer apparatus with a connecting apparatus according to the present invention.

FIG. 5 shows a transformer apparatus with the connecting apparatus according to the present invention. Connecting member 22 on which supporting plate 26 is adhered is laid on a top plane of a cylindrical structure composed of inner primary cylinder 10, outer primary cylinder 12, and a secondary winding therebetween. Connecting member 22 is positioned on the top plane of the cylindrical structure to match the projected terminal ends of each of conductive lines 24 with a plurality of parallel conductive lines 14 deposited on an inner wall of inner primary cylinder 10 and a plurality of parallel conductive lines 16 deposited on an outer wall of outer primary cylinder 12, respectively. The projected terminal ends of each of conductive lines 24 are folded to be positioned on land areas 20. Conductive lines 24 and land areas 20 are soldered by heat pressing or reflow soldering to form a primary winding. Though not shown, another connecting apparatus according to the present invention is installed on a bottom plane of the cylindrical structure to form a primary winding.

When the primary winding of a transformer is fabricated by use of the connecting apparatus and method according to the present invention, the reliable and speedy connection between the cap structure and conductive lines 14 and 16 deposited on inner and outer primary cylinders 10 and 12 is assured. Therefore, assembling expenses are cut down so that the overall manufacturing cost of a transformer apparatus is reduced considerably.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. In an apparatus electrically connecting inner and outer primary structures of a transformer, wherein said transformer comprises said inner primary structure being one part of a primary winding as an input part of said transformer, said outer primary structure being the other part of said primary winding as said input part of said transformer, and at least one secondary winding for an output part of said transformer, said inner primary structure being a first flexible sheet which has a first plurality of parallel primary conductive lines on a surface thereof and which is bent into a first primary cylinder, said outer primary structure being a second flexible sheet which has a second plurality of parallel primary conductive lines on a surface thereof and which concentrically surrounds said at least one secondary winding to form a second primary cylinder, and said at least one secondary winding being flexible laminated members which are arranged in a circular configuration concentrically about said first primary cylinder, the improvement in said apparatus electrically connecting inner and outer primary structures of the transformer comprising:

a rigid supporting plate being in a circular disc shape with an opening at the center thereof; and a connecting member being a flexible insulator sheet, wherein said supporting plate adheres to one surface of said connecting member, a plurality of radial conductive lines are deposited on the other surface of said connecting member, said connecting member has an opening at the center thereof, and first end portions of said plurality of radial conductive lines project beyond an inner peripheral edge which is a peripheral edge of said opening, said first end portions are inner end portions, second end portions of said plurality of radial conductive lines project beyond an outer peripheral edge which is a peripheral edge of said connecting member, said second end portions are outer end portions, said first and second end portions are folded to accommodate an electrical connection with one end portions of said first plurality of parallel conductive lines and one end portions of said second plurality of parallel conductive lines respectively so that said transformer maintains a structure having said primary winding which surrounds said secondary winding.

2. The apparatus electrically connecting inner and outer primary structures of the transformer as claimed in claim 1, wherein said connecting member is made of polyimide.

3. The apparatus electrically connecting inner and outer primary structures of the transformer as claimed in claim 1, wherein said second end portions of said plurality of radial conductive lines are wider in width than said first end portions thereof.

4. The apparatus electrically connecting inner and outer primary structures of the transformer as claimed in claim 1, wherein a land area is formed on the respective one ends portions of said first and second plurality of parallel primary conductive lines for the electrical connection with said plurality of radial conductive lines.

5. The apparatus electrically connecting inner and outer primary structures of the transformer as claimed in claim 1, wherein said supporting plate is made of fiberglass reinforced plastic(FRP).

6. In an apparatus electrically connecting inner and outer primary structures of a transformer, wherein said transformer comprises said inner primary structure being one part of a primary winding as an input part of said transformer, said outer primary structure being the other part of said primary winding as said input part of said transformer, and at least one secondary winding for an out put part of said transformer, said inner primary structure being a first flexible sheet which has a first plurality of parallel primary conductive lines on a surface thereof and which is bent into a first primary cylinder, said outer primary structure being a second flexible sheet which has a second plurality of parallel primary conductive lines on a surface thereof and which concentrically surrounds said at least one secondary winding to form a second primary cylinder, and said at least one secondary winding being flexible laminated members which are arranged in a circular configuration concentrically about said first primary cylinder, the improvement in said apparatus for electrically connecting inner and outer primary structures of the transformer comprising:

a rigid supporting plate being in a circular disc shape with an opening at the center thereof; and a connecting member being a flexible insulator sheet, wherein said supporting plate adheres to one surface of said connecting member, a plurality of radial conductive lines are deposited on the other surface of said connecting member, said connecting member has an opening at the center thereof, and first end portions of said plurality of radial conductive lines project beyond an inner peripheral edge which is a peripheral edge of said opening, said first end portions are inner end portions, second end portions of said plurality of radial conductive lines project beyond an outer peripheral edge which is a peripheral edge of said connecting member, said second end portions are outer end portions, said first and second end portions are folded to accommodate an electrical connection with one end portions of said first plurality of parallel conductive lines and one end portions of said second plurality of parallel conductive lines respectively so that said transformer maintains a structure having said primary winding which surrounds said secondary winding, wherein said connecting member is made of polyimide, wherein said second end portions of said plurality of radial conductive lines are wider in width than said first end portions thereof, wherein a land area is formed on the respective one ends portions of said first and second plurality of parallel primary conductive lines and electrically connected with said plurality of radial conductive lines, and wherein said supporting plate is made of fiberglass reinforced plastic (FRP).

7. The apparatus electrically connecting inner and outer primary structures of the transformer as claimed in claim 1, wherein said connecting member is made of polyester.

8. The apparatus electrically connecting inner and outer primary structures of the transformer as claimed in claim 4, wherein each of said land areas and each of said plurality of radial conductive lines is soldered by heat-pressing of the second end portions of said plurality of radial conductive lines and the one end portions of said plurality of parallel conductive lines.

9. The apparatus electrically connecting inner and outer primary structures of the transformer as claimed in claim 6, wherein said connecting member is made of polyester.

10. The apparatus electrically connecting inner and outer primary structures of the transformer as claimed in claim 6, wherein each of said land areas and each of said plurality of radial conductive lines is soldered by heat-pressing of the second end portions of said plurality of radial conductive lines and the one end portions of said plurality of parallel conductive lines.

* * * * *